US005479995A

United States Patent [19]

Falgout, Sr.

[11] Patent Number: 5,479,995

[45] Date of Patent: Jan. 2, 1996

[54] ADJUSTABLE ORIENTING SUB

[76] Inventor: Thomas E. Falgout, Sr., 110 Charles Read St., Lafayette, La. 70503

[21] Appl. No.: 270,760

[22] Filed: Jul. 5, 1994

[51] Int. Cl.[6] ..... E21B 7/08

[52] U.S. Cl. ..... 175/74; 175/101

[58] Field of Search ..... 175/73–75, 101, 175/107

[56] References Cited

U.S. PATENT DOCUMENTS

| | | | |
|---|---|---|---|
| 4,286,676 | 9/1991 | Nguyen et al. | 175/320 X |
| 4,770,258 | 9/1988 | Falgout | 175/73 |
| 5,029,654 | 7/1991 | Wilson et al. | 175/256 X |
| 5,050,692 | 9/1991 | Beimgraben | 175/256 X |
| 5,094,305 | 3/1992 | Wenzel | 175/75 X |
| 5,168,943 | 12/1992 | Falgout | 175/256 X |

*Primary Examiner*—Roger J. Schoeppel
*Attorney, Agent, or Firm*—John D. Jeter

[57] ABSTRACT

The sub, usable as a length of drill string which may include a drilling motor body, includes three generally tubular members and an indicator ring. Two of the members have tool joint boxes with straight threads one threaded onto each end of a double ended tool joint pin. The pin has no shoulder but has an annular ring separating the faces of the boxes. The annular ring is keyed to the pin but is free to move axially some distance. One end of the pin and the mating box has coarser threads than the opposite end and the mating box threads. Before the assembly is torqued up for field use the pin may be rotated in the boxes by turning the ring. As the ring turns the finer threaded box has to turn faster in the same direction to maintain contact between all faces. This changes the rotational relationship between opposite ends of the sub and provides control of rotational orientation of opposite ends of an attached drill string. For use as a deflection sub the axes of the pin and all associated threads are tilted relative to axes of the the opposite end menders of the sub. When the pin is rotated in the boxes the same thing happens as described above but the axis of end members rotated on the stationary pin describe a cone. The rotation can be stopped at any end-to-end deflection from a straight condition up to twice the angle between pin axis and end axes.

19 Claims, 2 Drawing Sheets

ADJUSTABLE ORIENTING SUB

This invention pertains to adjustable drill string elements usable to change the rotational orientation between opposite ends of a drill string or to change the amount of bend in a bent sub. The tool is primarily usable in drill strings used for directional drilling. In the bent sub version the use may include bending a drilling motor body, which is commonly considered part of the assembled drill string. This invention is an improvement upon my issued U.S. Pat. No. 5,168,943 issued Dec. 8, 1992.

BACKGROUND OF THE INVENTION

Directional drilling is a well established art in the well drilling industry. Various elements are available for inclusion in the drill string to influence the course of the well bore as drilling progresses. Apparatus for use down hole to indicate at the surface various parameters measured down hole are now in common use and are generally known as Measurement While Drilling or MWD arrangements. At the present time the drill string has to be rotationally oriented relative to earth to measure and influence the course of the well bore as it is further drilled.

With frequent down hole measurements now readily obtainable, small deflections of the axis in the down hole assembly can usually accomplish all changes required during a normal bit run. Bent subs with axial deflections in the range of three degrees are quite common. The small deflections permit the drill string to be rotated without overstressing the string in the vicinity of the bent sub provided the bent sub is of robust construction.

There are two salient problems in making up the down hole assembly to drill with directional control with bent elements. The first problem pertains to rotational alignment of drill string components separated by threaded connections. The second problem pertains to adjustably bending the bent sub to deflect the centerline of the lower portion of the string relative to the upper portion. Apparatus of this invention addresses both problems with almost identical constructions.

It is therefore an object of this invention to provide an adjustable orienting sub to change the relative rotational orientation of axially spaced portions of the drill string.

It is another object of this invention to provide an adjustable bent sub to select the amount and secure the selected deflection of the drill string centerline.

It is yet another object to provide adjustable orienting subs that require no shims and may complete the adjustment by application of torque in the manner used on tool joints and with the same tongs.

It is still another object of this improvement to provide visible, manually controllable, features for all elements of the sub to be manipulated during adjustment and torque application.

It is yet a further object of this invention to provide the adjustable sub usable in a drilling motor body to change, at least, the axial deflection between upper and lower tool joints of the motor.

These and other features and advantages will be apparent to those skilled in the related art from consideration of the included claims and appended drawings.

SUMMARY OF THE INVENTION

The alignment sub is provided in two forms, a rotational alignment sub and an axis deflection sub. Common features will be described first.

There are three essential tubular members and one annular ring. Two tubular members, called stubs, each have means to attach to a continuing drill string such that the attached drill sting extended centerline coincides with the general axis of the stub each having straight threaded bores, or boxes, with each box facing the other when assembled. One box has threads of greater helical pitch than the other. The third tubular member is a double ended shoulderless pin extending threadedly into each box to form a generally elongated tubular assembly with opposite ends of the pin threadedly mating with the threads of the related box. A fourth element is an annular ring, an indicator ring, rotationally affixed for axial movement on the third tubular member and it is sized to be captured between opposed faces of the boxes of the stubs and approximate the outer diameter of the stubs to provide a visual reference for the rotational position of the pin relative to the two stubs. Set screws penetrate the walls of the boxes to engage the third element when tightened to prevent rotation of the third element relative to the boxes and can be selectively loosened to allow the pin to rotate relative to a selected box when adjustments are underway.

If the sub is used in a drilling motor body, either or both stubs may be part of the motor body. In that case one stub may be the bearing housing that supports an output shaft to attach to the continuing drill string. In motors, the drive shaft may continue through the sub bore.

When the sub is assembled, the faces of the boxes are threadedly drawn into contact with opposite faces of the indicator ring and torqued up to qualify as an element of a drill string.

To accomplish adjustment, preference is for the set screws to be loosened to allow the pin to rotate in the coarse threaded box and that box is rotated a preselected amount relative to the pin and the set screws are tightened. The set screws are then loosened on the fine threaded box and the two boxes are rotated to tighten them on the pin. By preference, the fine thread has half the pitch of the coarse one and it takes twice the amount of rotation relative to the pin to bring the faces back to the torqued up state. The rotational relationship between the two stubs is then changed by the amount of first rotation of the coarse box relative to the pin, but in the opposite direction. Different pitch ratios of the boxes would obviously alter the amount of the second, tightening, rotation of the opposite stubs. The pitch ratio is a designers choice and does not alter the principle involved or the predictability of the result.

The adjustment of the rotational alignment sub has been described and the adjustment of the deflection sub differs only slightly and that adjustment will now be described. The pin and associated boxes have mutual center lines and, in this sub, the pin center line crosses the stub center lines. When a box is rotated relative to the pin the related stub center line describes a cone about the pin axis originating between the two box faces which are perpendicular to the pin axis. The rotation can obviously be stopped with the stub axis at any line on the cone. The pin can then be rotated relative to both boxes and the differential threads can draw the two box faces against the indicator ring faces. The indicator ring is keyed to the pin and can move axially thereon but it is not suitable, by choice, for applying drill string assembly torque. Pin rotation is suitable for descriptive use but, in practice, the rotational manipulation is the same as described above for the rotational alignment sub.

Adjusting the deflection sub always results in change in the rotational relationship of its opposite stubs and, consequently, does the same for opposite ends of an attached drill string. A two degree angle between pin and drill string center lines can yield any amount of deflection from zero, straight configuration, to four degrees deflection between stub axes.

When in the straight configuration, all three center lines lie in the same plane. If one box is rotated 180 degrees on the pin all axes are again in the same plane with the sub at maximum deflection. A scribe line, or tool face is, by common practice, defined as the line on the outside surface of the sub, in the plane, on the short side of the sub. Since this sub is adjustable, that line is defined as the stub reference line, primarily for shop use, for the life of each of the stubs. To select a preferred angle of deflection, one stub is loosened relative to the pin until the preferred angle is approximated leaving some rotation for torque completion. The other stub is then turned relative to the pin until the box faces close on the indicator ring and the torque is applied to opposite ends of the sub. The pin angle relative to boxes is no longer of interest. The final tool face now differs from that of the rotational alignment sub. The final tool face, or scribe line lies half the least peripheral distance between the two box reference lines. The pin and both boxes will always have the same rotational relationship when that deflection angle is again selected and all three can be empirically scribed with the deflection amount defined. The indicator ring is the only visible part keyed to the pin and it receives the quantified scribe. By the same process, all likely deflection angles can be scribed on all three parts when the angle is proved. They will be in different locations but the angle will be repeated each time the three identical quantified scribes are aligned and the tool face will be in the plane of the aligned scribes, always midway between the reference lines of the boxes. The tool face of the readjusted deflection sub will always be rotationally changed from the previous upstring, usually MWD, tool face or radial reference line. The rotational alignment sub corrects that problem.

BRIEF DESCRIPTION OF DRAWINGS

In the drawings wherein like features have similar captions.

DETAILED DESCRIPTION OF DRAWINGS

Figure 1:
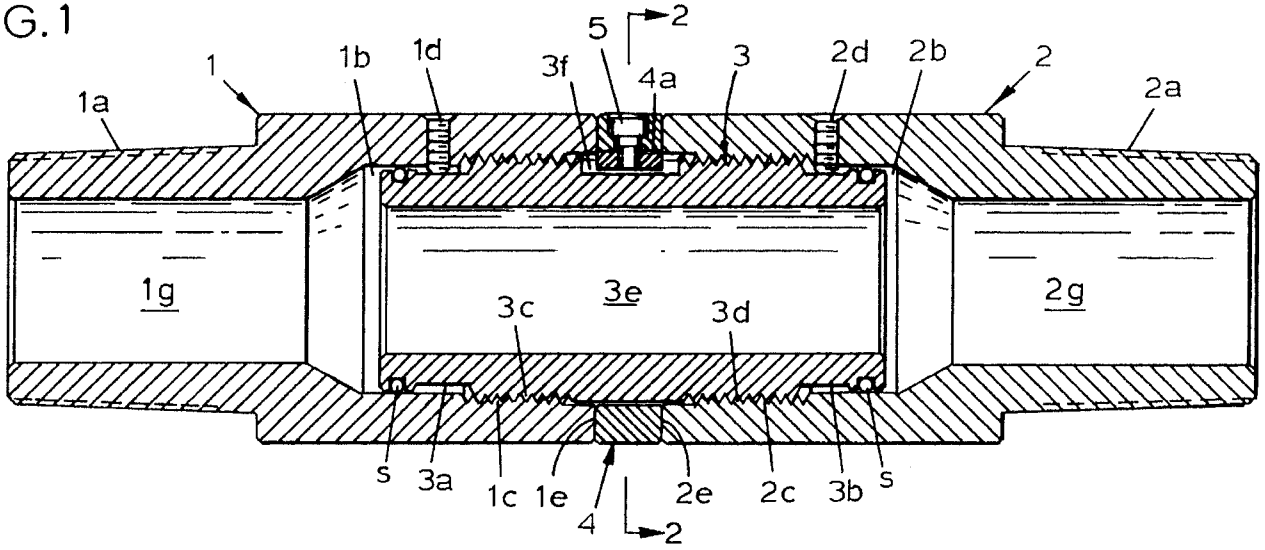
FIG. 1 is a sectional view of the rotational alignment sub.

The general description of construction and manner of use has been described and general details of the preferred constructions will now be described. In FIG. 1 stub 1 is generally cylindrical with means to attach to a continuing drill string being tool joint 1*a*, which can be either box or pin. It has an extended centerline coaxial with straight threaded box bore 1*b*. Stub 2 is identical with stub 1 with the exception of threads in the boxes. Threads in the two boxes differ in pitch. The preferred arrangement is for both boxes to have the same thread form with one box single thread and the other double thread. The single pitch thread size depends upon the sub diameter and usually approximates the pitch of the associated tool joint threads recommended for the sub diameter.

Figure 2:
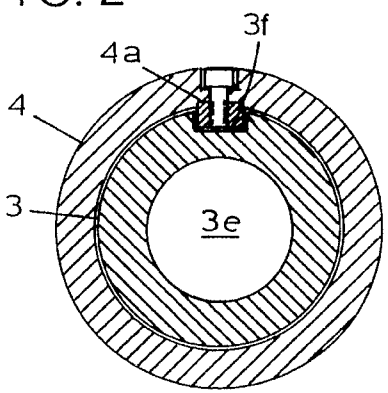
FIG. 2 is a section taken along line 2—2 of FIG. 1.

Member 3 is a double ended shoulderless pin with bore 3*e* and major diameter of threads 3*c* and 3*d* approximating those dimensions for recommended tool joint connections, mating with threads 1*c* and 2*c* in the associated boxes. Indicator ring 4 is keyed to pin 3 by key 4*a* in mating key way 3*f* and is free to move axially along the pin some distance (note the FIG. 2 arrangement). Key 4*a* is attached by a fastener to the ring body. There are three set screws for each stub arranged to grip surfaces 3*a* and 3*b*. They are peripherally distributed about each sub in a transverse plane, about equally spaced. One set of three includes set screw 1*d* for stub 1 and one set of three includes get screw 2*d* for stub 2. When either set of set screws is loosened, the associated box can rotate relative to the pin.

Figure 4:
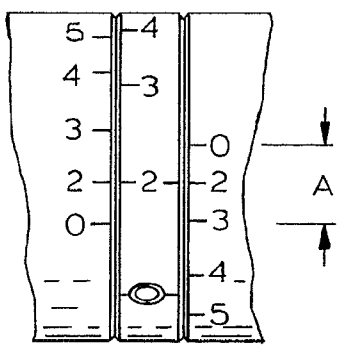
FIG. 4 is the same as FIG. 3 with the tool in a different state of adjustment.
Figure 3:
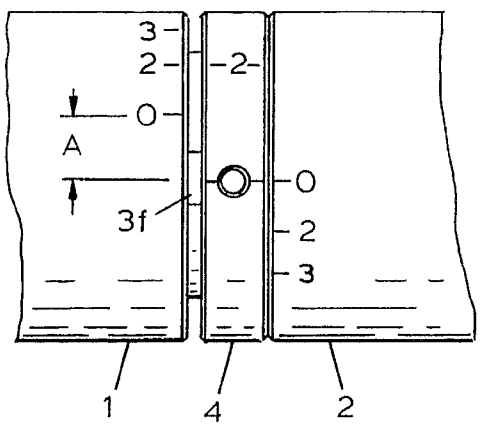
FIG. 3 is a fragmented side elevation of a selected area of the sub of FIG. 1

For use in well drilling practice some markings are preferred for aid in manipulating the three principal members and those will be described. Assuming all box and ring faces are in contact and there is no rotational correction and that the ring and all selected reference scribes shown as 0 in FIG. 3 are in registry, the first step is to rotate stub 1 a preferred amount A relative to the pin which opens a gap between stub 1 and the ring as shown. The second step is to rotate the stub 2 (fine threaded box) twice as much relative to the pin to bring both stub faces and the ring back into contact. Stubs 1 and 2 have now been rotated an amount A relative to each other. Opposite ends of the associated drill string, not shown, are now rotationally reoriented an amount A. Assume this amount is twenty degrees. The ring and both ends will always have the same relationship when that amount of reorientation is later re-established. All three visible components can be scribed and actual measurements are no longer necessary. Here, 2 symbolically represents twenty degrees. All adjustments are made at the surface. The sub is now torqued together by conventional tool joint tongs. Experience will indicate how much the torque will change the setting and that amount is allowed when performing the setting described above so that the preferred setting results from the final application of torque. FIG. 4 represents the setting after final torque is applied.

Addressing now the deflection version of the sub, FIG. 6 will first be described. It is shown adjusted to the straight configuration. This sub is identical to that of FIG. 1 except that the pin has an axis tilted to cross the stub axes. Identical in construction to corresponding elements of FIG. 1 are set screws 7*c* and 8*c*, surfaces 9*e* and 9*d*, ring 10, key 10*a*, keyway 8*d* and fastener 6. Excepting the tilt of the pin axis also identical are mating threads 7*b* and 9*b* and mating threads 8*b* and 9*c*. Abutments 7*e* and 8*e* are parallel to plane P which is perpendicular to the pin axis L3. Lines L1 and L2 may be considered drill string centerlines up to the ring from each end. By preference, the pin axis crosses at the midpoint between the two box faces. The box bores each enter the associated stub near that end centerline at an angle commonly in the range of two degrees. The box faces define a plane perpendicular to the pin centerline and the angle $\phi$ is, preferably, the same for both boxes. With all three axes in the same plane there are two salient rotational relationships between opposite ends. The sub is straight when the pin axis extends on opposite sides of the center lines of the opposed stubs. When the pin axis extends on the same side of the center lines of both stubs the sub is at maximum deflection.

The overall deflection of the sub is then twice the angle $\phi$. This relationship is shown in FIG. 5.

When the sub is deflected the tool face, or scribe line, is a line on the outer surface of the sub cut by a plane containing the axes of both stubs. For maximum deflection the scribe lines R are placed on the stubs near the box faces as shown. Stub 8 has been rotated from the straight configuration of FIG. 6 180 degrees relative to stub 7. This change required the corresponding rotation of the pin relative to both boxes as previously described. The indicator ring will always be in the same position when this setting is later used and a corresponding scribe line is placed on the ring in registry with lines R. This will always be four degrees in this particular sub and the letter 4 is preferably stamped near the stub reference lines and on the ring.

Figure 6:
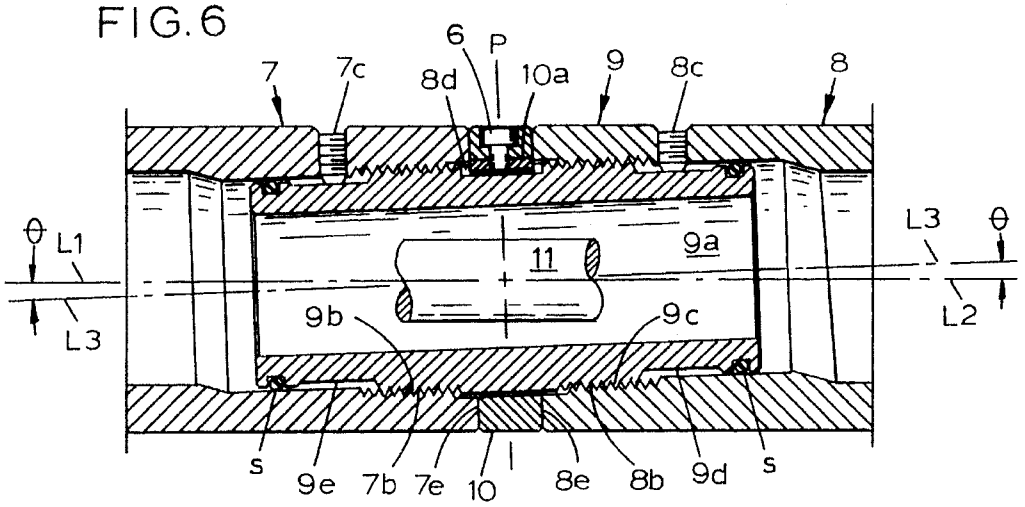
FIG. 6 is a sectional view of a deflection variant of the sub of FIG. 1.
Figures 8, 9, 10:
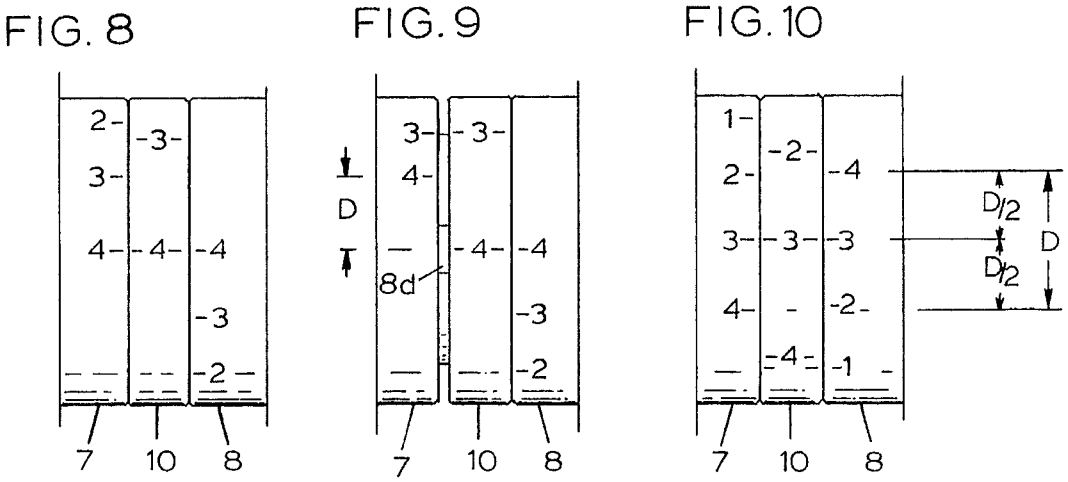
FIG. 8 is an elevation of a selected area of the sub of FIG. 1 showing a state of the adjustment process.
FIG. 9 is similar to FIG. 8 with the sub in another state of adjustment.
FIG. 10 is similar to FIG. 9 with the sub in a further state of the adjustment process.
Figure 5:
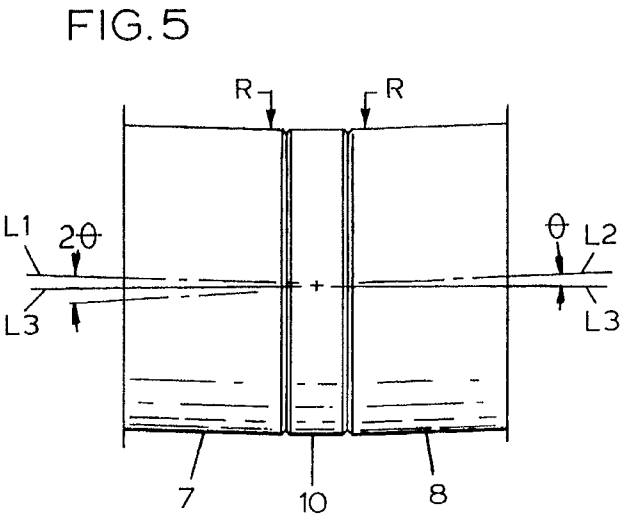
FIG. 5 is a fragmented elevation of a selected area of the sub of FIG. 6.

Between the positions shown in FIGS. 5 and 6 an infinite number of deflection settings can be established up to the four degree limit for this sub. Setting the deflection and establishing the resulting tool face now differs from that of the rotational orienting sub of FIG. 1. FIGS. 8, 9 and 10 will illustrate the difference. In the most deflected state the scribe lines will be in registry at four degrees and 4 can be stamped on both stubs and the ring as shown in FIG. 8. To adjust to three degrees, the coarse threaded box in stub 7 is unscrewed from the pin an amount D to leave a gap between stub 7 and the ring as shown. The fine thread box in stub 8 turns twice as much to close the gap and the stamped 4, also the scribe line, will be displaced an amount D as shown in FIG. 10. The tool face will be in the plane containing the center lines of the two ends half way between the two reference lines. The three visible components will always have the same rotational relationships at that setting and all can be stamped with the number 3. The same process is followed for other, preferred, increments of adjustments. The tool face will always be coincident with the three identical numbers in registry. After shop proof marking of each new size of sub assembled to field use torque serial products to follow can be shop stamped during production. The description of a four degree sub is not to be interpreted in a limiting sense.

Figure 7:
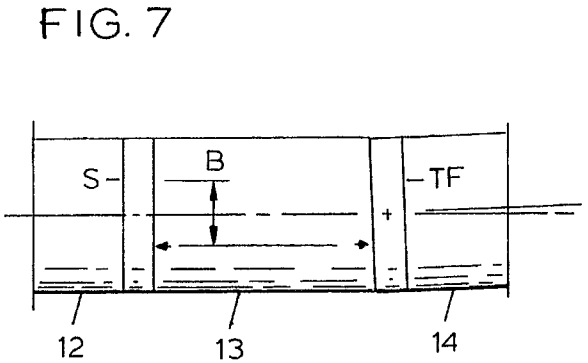
FIG. 7 is a side elevation, rather reduced in scale, of a combination sub of both FIGS. 1 and 6.

FIG. 7 shows a combination rotational alignment and deflection sub in which member 13 has boxes in both ends, one coaxial and one deflected. Stub 12 can be identical to stub 1 of FIG. 1 and stub 14 can be identical to stub 8 of FIG. 6. Further, member 13 can be an upper motor housing with member 14 serving as the motor bearing housing. Scribe line S is related to a reference in the upper drill string, here shown as the left end, and the line TF is the tool face as defined herein for FIG. 10. The displacement B may have resulted from adjustment of the deflection sub and is corrected by the rotational alignment sub. Scribe S and the tool face TF are again in registry. The bent version is shown above the rotational alignment sub but the combination can be arranged with opposite positions.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the tool of this invention without departing from the scope thereof, it is to be understood that all matter herein set forth or shown in the accompanying drawings is to be interpreted as illustrative and not in a limiting sense.

The invention having been described, I claim:

1. An improved adjustable orienting sub for use as a length element in a drill string to adjustably change the relative orientation between drill string portions axially separated by the sub, the sub comprising:

a) a first member having a first axis, means at a first end for fluid tight attachment to a drill string, a fluid channel extending generally along said first axis and a second end with a generally transverse first annular abutment and a generally coaxial bore, relative to said first axis with straight threads;

b) a second generally tubular member having a second axis, generally coaxial threads, relative to said second axis on a first end to mate with threads in said first member, and generally coaxial threads, relative to said second axis, on a second end having a pitch different than said threads on said first end;

c) a third member having a third axis, means at a first end for fluid tight attachment to a drill string, a fluid channel extending generally along said third axis and a second end with a generally transverse annular abutment and a generally coaxial bore, relative to said third axis, with straight threads to mate with said threads on said second end of said second member;

the improvement comprising, d) an annular ring with a length defined by generally parallel annular abutments, to separate and mate with said abutments on said first two members, with means for mounting on said second member between said threads thereon, secured for sympathetic rotation therewith for axial movement relative thereto, arranged to serve as a rotational position indicator for said second member relative to said first and third members;

whereby a change in the rotational relationship between said ring and either said first or said third member produces a change in the rotational relationship between said first and third members.

2. The improved sub of claim 1 wherein said three axes extend generally along the same line.

3. The improved sub of claim 1 wherein the axes of said second member and the axes of all said threads cross the axis of each said first and said third members in the vicinity of said ring whereby change in the rotational relationship between said first and said third members results in a change in the deflection between said axes of said first and said third members to accomplish a change in the deflection of the axes between drill string elements attached to and extending from each end of the sub.

4. The improved sub of claim 1 wherein set screws are arranged in at least one of said first or said third members to engage said second member to prevent rotation of said second member relative to at least one of said first or third members.

5. The improved sub of claim 3 wherein all said abutments are generally perpendicular to said axis of said third member.

6. The improved sub of claim 1 wherein said threads differ in pitch such that threads in said first member are single pitch threads and threads in said third member are double pitch threads.

7. An improved orienting sub for use as a length element of drill string, comprising: a body having at least three generally tubular members, a generally central axis, a drilling fluid channel extending axially through the sub, means at each end to attach to a continuing drill string, all three members threadedly assembled in axial series, a first thread in a first member arranged to engage mating second threads on a second member, said second member having third threads arranged to threadedly engage fourth threads in said third member, said second member having a centerline coaxial with all said threads, said first and said third members having opposed annular abutments that are generally perpendicular to said centerline, said second and third threads having different pitch such that selected rotation of said second member while said first and third members are stationary causes the distance between said abutments to increase such that the amount of rotation of said second member determines the amount of rotation of said third member relative to said first member required to bring said abutments back to the starting separation, an annular indicator ring situated about the periphery of said second member between said second and third threads, rotationally secured to for axial movement thereon having a length defined by generally transverse annular abutments situated to mate and engage said abutments on said first and third members;

whereby changing the rotational relationship between said first and said second members produces a changed rotational relationship between said first and said third members.

8. The improved sub of claim 7 wherein said centerline and said axis are on the same line.

9. The improved sub of claim 7 wherein the centerline of said second member crosses said axis in the vicinity between said abutments such that changing the rotational relationship between said first and said third members also deflects said axis in said vicinity an amount proportional to the amount of said rotation of said first member relative to said third member up to an amount twice the amount of angle between said centerline and said axis before deflection.

10. The improved sub of claim 9 wherein said first member is the upper portion of the body of a drilling motor and said third member is a lower portion of a drilling motor body that contains the support bearings for motor output drive shaft which serves as means to attach to the downwardly continuing portion of the drill string.

11. The improved sub of claim 7 wherein said second member comprises a double ended, straight threaded, and shoulderless tool joint pin with an annular indicator flange rotationally affixed for axial movement thereon, said first and third members arranged to secure said indicator ring between said abutments to provide a visual reference for the rotational position of said second member relative to the other two said members.

12. The improved sub of claim 7 wherein at least one of said members has releasable means to temporarily rotationally secure at least one of said first and third members to said second member.

13. The improved sub of claim 7 wherein said means to secure comprises at least one set screw situated in at least one of said first and third members arranged to engage a surface on said second member.

14. The improved sub of claim 7 wherein said second member is sealingly situated in said first and third members to prevent exposure of said threads to drilling fluid pressure in said fluid channel.

15. An improved adjustable orienting sub for use as a length element in a drill string to adjustably change the relative orientation between drill string portions axially separated by the sub, the sub comprising:

a) a first tubular member having means at a first end for fluid tight attachment to a drill string, a generally transverse first annular abutment on an opposed end, and a bore with internal threads therein;

b) a second tubular member having means at a first end for fluid tight attachment to a drill string, a generally transverse second annular abutment on an opposed end, and a bore with internal threads therein;

c) a third tubular member mounted within and extending between said first and second tubular members, said third tubular member having external threads on one end to mate with said internal threads in said first tubular member and external threads on the opposed end to mate with said internal threads in said second tubular member; and means to permit selected rotation of said first and said second tubular members relative to said third tubular member and relative to each other;

the improvement comprising, d) an annular ring with a length defined by generally parallel annular abutments, to separate and mate with said first and said second abutments on said first and said second tubular members; and means for mounting said ring on said third tubular member for rotation therewith to provide a visible rotational position indicator for said third tubular member relative to said first and second tubular members.

16. The improved sub of claim 15 wherein said internal threads in said first member are of a pitch different from said internal threads in said second member.

17. The improved sub of claim 16 wherein said external threads on said one end of said third member have a pitch different from said external threads on said other end of said third tubular member.

18. The improved sub of claim 15 wherein said mounting means for said ring permits limited axial movement of said ring relative to said third member with a change in the rotational relationship between said ring and either said first or said second tubular member producing a visible change in the rotational relationship between said first and said second tubular members.

19. The improved sub of claim 15 wherein said mounting means for said ring is positioned between said external threads on said one end and said opposed end of said third tubular member.

* * * * *